US005783996A

United States Patent [19]

Muszynski

[11] Patent Number: 5,783,996

[45] Date of Patent: Jul. 21, 1998

[54] PORTABLE GRAVITY ACTIVATED ALARM DEVICE FOR GOLF BAGS AND OTHER SIMILAR ITEMS

[76] Inventor: Francis E. Muszynski, 8500 N. Golfview Dr., Citrus Springs, Fla. 34434

[21] Appl. No.: 680,388

[22] Filed: Jul. 15, 1996

[51] Int. Cl.[6] ..... G08B 13/14

[52] U.S. Cl. ..... 340/571; 340/689; 200/61.45 R

[58] Field of Search ..... 340/571, 689, 340/568, 429, 666; 200/61.45 R

[56] References Cited

U.S. PATENT DOCUMENTS

| | | | |
|---|---|---|---|
| 4,275,391 | 6/1981 | Okamura | 340/571 |
| 4,575,713 | 3/1986 | Piper | 340/569 |
| 5,148,150 | 9/1992 | White et al. | 340/571 |

*Primary Examiner*—Jeffrey Hofsass
*Assistant Examiner*—Sihong Huang

[57] ABSTRACT

A portable alarm device which comprises an enclosed compartment within which a spring-loaded triggering device may be locked into an alarm position by a magnetic field and held there until properly switched off. The apparatus further comprises a battery power supply and locking apparatus for locking it into a disarmed position.

17 Claims, 7 Drawing Sheets

PORTABLE GRAVITY ACTIVATED ALARM DEVICE FOR GOLF BAGS AND OTHER SIMILAR ITEMS

FIELD OF THE INVENTION

The invention relates to alarm or security devices, particularly those which might be useful in temporary and movable structures or accessories such as golf bags.

BACKGROUND OF THE INVENTION

A golfer will frequently have in excess of a thousand dollars invested in the equipment used to play the game. During the course of playing a round, it is frequently necessary or convenient for a golfer to briefly leave the immediate vicinity of such primary equipment by leaving his or her golf bag, clubs, wet weather gear, pull cart and other such things to visit the restaurant or snack bar during the course of a round, use the restroom, or socialize.

It may also be necessary to leave such equipment in line at a teeing area while going to hit range balls or some other such activity. In these cases the valuable golf equipment may be left unattended and unguarded. A thief could easily remove the equipment and place it on a nearby automobile or golf cart and be out of the area without detection. Security at golf courses is normally not extensive.

This is because golf courses are frequently patronized by the general public and there are limited supervisory personnel available to keep close watch over all such activity. A golf course is a very large place and there are numerous places where the golfer and his equipment could become separated in the presence of a number of unknown people.

Various forms of alarm devices have been devised for small articles. There are some such devices which have been contemplated for use in such an environment. These include a variety of small electronic chirping alarms. Such alarm devices, however, typically may be easily removed or inactivated.

For instance, U.S. Pat. No. 4,728,937, issued to Hsu on Mar. 1, 1988, teaches a security means for a suitcase. In Hsu, the motion of a liquid metal, such as mercury, may connect a circuit and cause either or both an alarm to sound and then electric shock to be delivered to a thief. The invention taught by Hsu is incorporated within the structure of the suitcase and comprises various components and elements all about the periphery of the suitcase. It also is integrated with the combination locking devices of the suitcase. This device could only be used on a specific parcel.

U.S. Pat. No. 4,841,285, issued to Laut on Jun. 20, 1989, teaches another tilt responsive alarm system. Unlike Hsu, the invention taught by Laut is meant to protect a display case. Like Hsu, however, Laut teaches an alarm system which is designed to react to the movement of a liquid metal, such as mercury. The invention of Laut is "L" shaped so as to conform to the corner of a display case. Laut generally teaches an "L" shaped apparatus which encloses a conical pool of mercury within which are disposed concentric conducting rings. When sufficient tilt causes the mercury within a cone to make contact between the concentric rings, the alarm is triggered. The invention taught in Laut, in addition to being "L" shaped, must be permanently fixed in a case which is in an upright position.

The importance of golf club security is recognized in U.S. Pat. No. 5,004,100, issued to Smith on Apr. 2, 1991. This invention teaches a means of securing golf clubs within a bag and further to secure the golf bag to a fixed apparatus. Smith, however, does not teach an alarm mechanism.

U.S. Pat. No. 4,489,314, issued on Dec. 18, 1984, to Sheldon Miller, and U.S. Pat. No. 5,028,909, issued on Jul. 2, 1991, to Robert Miller (apparently unrelated) each teach systems for applying monitoring sensors within a golf bag to determine the presence or absence of a given club. These inventions require a web of circuitry within the golf bag. They do not treat the problem of removal of the golf bag.

U.S. Pat. No. 5,041,815, issued to Newton on Aug. 20, 1991, teaches yet another variation of golf bag alarm devices. Newton teaches an alarm switch which is activated by weight. The apparatus of Newton is activated when the weight of the golf bag is removed from a sensing apparatus on a golf cart. Newton does not teach an apparatus which depends upon tilt or movement unless the movement is sufficient to remove the bag from its place. The alarm of Newton is fixed to the area of storage of the bag and does not travel with the bag. Accordingly, if a thief is able to leave the area quickly, the alarm will be of little benefit in showing where the thief has gone.

U.S. Pat. No. 5,162,778, issued to Williamson on Nov. 2, 1992, teaches yet another mercury switch may be used to protect personal property. The invention taught by Williamson is capable of operation at a selected angular orientation.

What is needed but not provided in the present art is such an alarm device which may be concealed on or within a golf bag and which could easily be switched on and off at the desire of the golfer. Additionally, no alarm device which continually sounds the alarm and travels with the protected golf bag until the thief either abandons the effort to steal the golf equipment or the equipment otherwise is reacquired by the owner has been designed and would be helpful.

SUMMARY OF THE INVENTION

The Inventor has overcome the shortcomings of the prior art by providing a detachable alarm device which may be easily concealed within or about the pockets of a golf bag or otherwise positioned on the bag so as to be concealed from view. Such device would include a gravity-activated triggering device together with a locking mechanism which would hold the alarm in the activation mode until the owner could switch it off by turning a precise sequence of knobs or switches which would be unknown to a thief. Such apparatus could further be adapted for use in other similar situations such as with bicycles, briefcases, or other similar adaptations.

In general, the inventor has developed an encased alarm device within which a wire spring is used to provide sufficient tension to hold an alarm arm in an appropriate position as long as it is maintained substantially upright. If the alarm is, however, allowed to be turned sufficiently horizontal, a metal plug will move into a position to attracted to a magnet closing an alarm circuit. The magnet will hold the arm in this position, continually activating the alarm, until properly switched off. There are a variety of hidden pockets and spaces in a golf bag so that a thief would require some time in order to locate the alarm device. As the alarm device would be traveling with a golf bag until the thief found it and tossed it away (the thief would not be able to turn it off without knowledge of the proper sequence), it is likely that the thief would abandon the golf bag in order to avoid being caught.

It is an object of the present invention to provide a gravity-activated alarm device for providing warning of the attempt of a thief to steal golf equipment.

It is a further object of the invention to provide such a device which may be easily concealed on or about a typical golf bag.

It is a further object of the present invention to provide such a device which will continue to sound an alarm until switched off by the use of a specific sequence of operations.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

Figure 1:
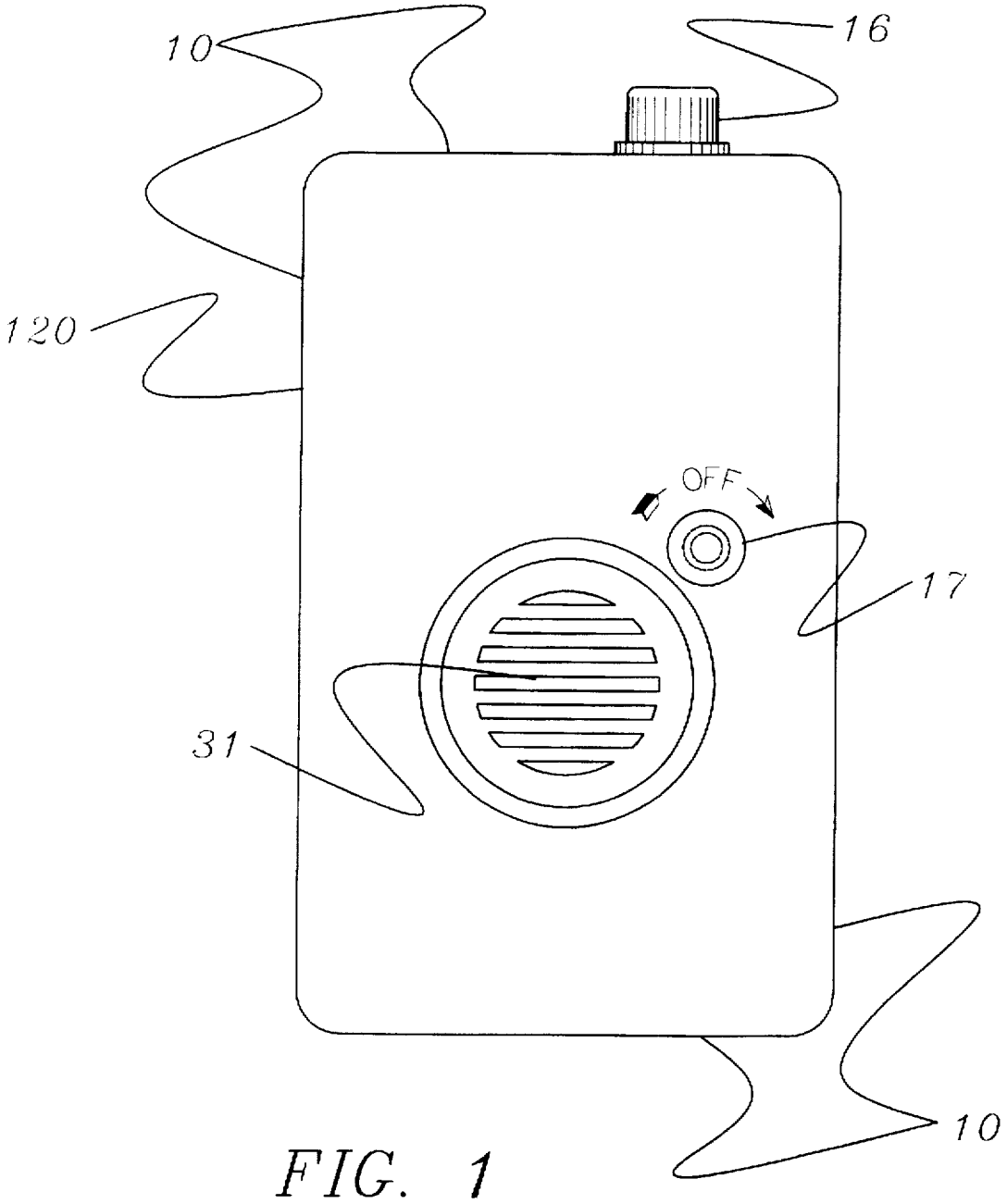
FIG. 1 is a depiction of a front cover of the device taught herein.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims. While the following description will seek to improve understanding of the invention by describing the various components and elements, it should be considered that certain apparatus may be sufficiently and adequately explained by the accompanying drawings, which are fully incorporated herein, and not require further description. All such apparatus should be considered as part of the specification of the invention for all purposes.

Making reference first to FIG. 1, the present invention, which relates to new and useful improvements in golf bag security alarms, depicts the visible components of an alarm device which will set off an alarm when tilted to a more horizontal position when taken by golf bag handle or golf bag shoulder strap, or lifted straight up. Further depicted in FIG. 1 is the front cover (120) of the golf bag security alarm device (10) according to the present invention in which the audio port (31), locking knob (16) and control arm adjusting knob (17) are depicted.

Figure 2:
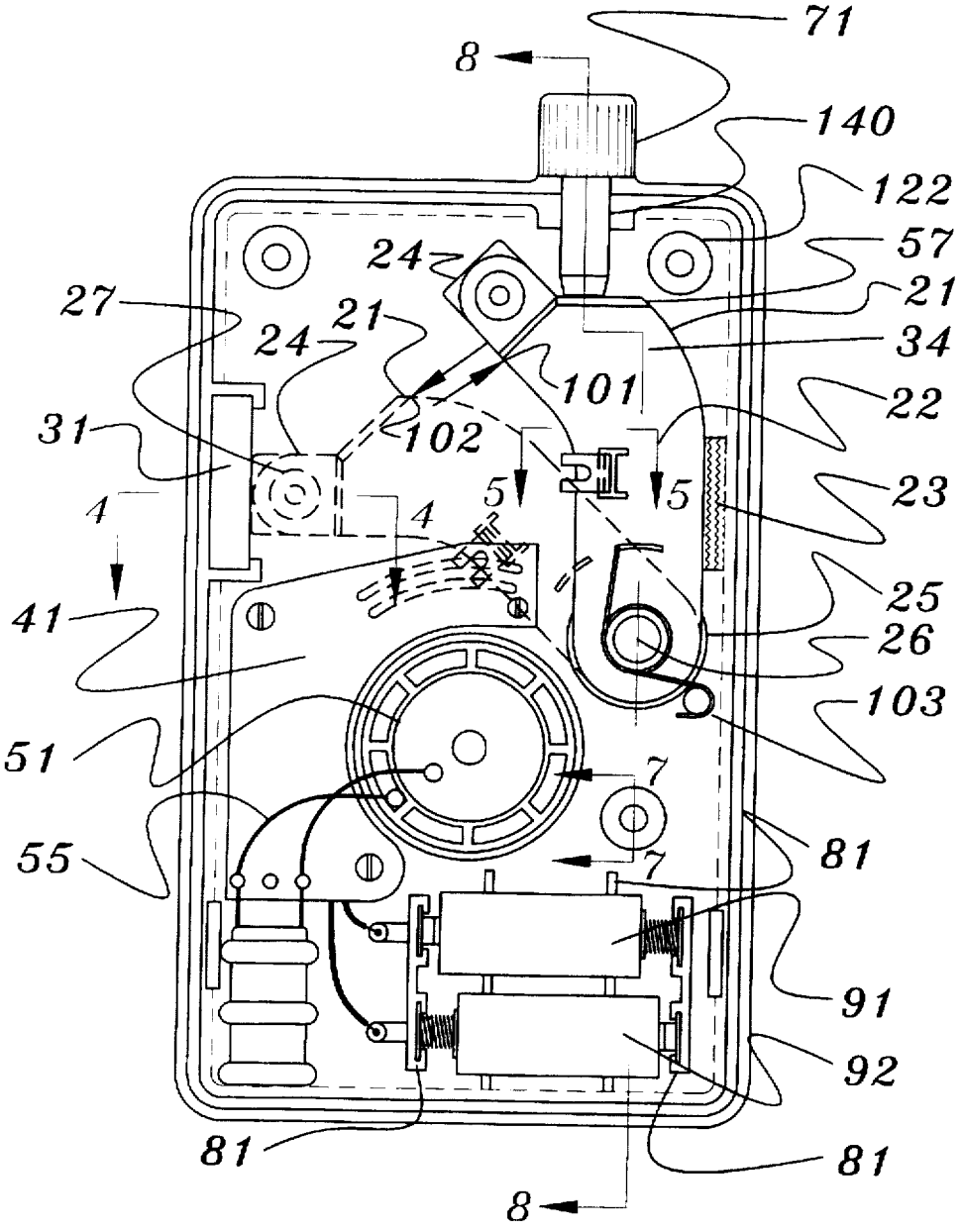
FIG. 2 is an overall view of the primary components of the apparatus including the gravity-loaded switch, the magnetized circuit loop, alarm-sounding signal, and power source.

FIG. 2 is an interior front view of the alarm assembly with its working parts. The main control arm (21) with shaft assembly (22) can be seen along the side in the locked, or alarm off, position (101) and in the activated, or alarm on, position (102). Along one side of the compartment can be seen a styrene cushion (23), glued into place to stop the control arm (21) and keep it from rattling. Also seen is the wire coil spring (25) upon which is attached the base of the control arm (21). A pin (26) protrudes formed from the security alarm device (10) to maintain the axis of the wire coil spring (25) which is anchored at a base line (103). The wire coil spring (25) must keep the control arm (21) near 25 degrees of displacement from the vertical locked, or alarm off, position (101).

The counterweight (27) will allow control arm (21) to move down against the tension of the wire coil spring (25) by gravity, then the magnet (31) will take over and will pull the control arm end assembly (24) to magnet (31) by magnetism, this in turn will engage alarm switch (41), an alarm (51) will sound at an appropriate degree of rotation. The steel counterweight (27) that may be riveted to the control arm (21) by a rivet (29) in a channel (104). When the control arm (21) is near or on 41 degrees of rotation from the vertical locked, alarm off, position (101), the magnet (31) will engage alarm switch (41) and hold the control arm (21) in alarm on (102) position.

The alarm (51) will be energized by the steel point contact spring (52) completing current to contact points (53, 54) that are soldered on a circuit board (55). Two 1.5 volt (N-size) batteries (91, 92) could be used to activate the alarm (51). When turning off the alarm (51), it is necessary to turn the locking screw (140) counter-clockwise about one-quarter turn. To shut off the alarm (51) turn the knob (17) of the control arm (21) counter-clockwise, thus disengaging the electrical contact point (44) from the contact points (53, 54). It is now possible to continue turning the knob until the control arm (21) stops at the styrene stop (23). Now while holding the control arm knob (17), it is possible to tighten down the locking screw (140) slowly until it stops turning. Now the control arm (21) will be locked into the disarmed position. Both the locking screw (140), and the control arm knob (17) can be turned without the use of tools. However, to enhance the effectiveness of the device it may be optional to provide an allen wrench socket or other "key" type device to make it more difficult to turn off and disengage. Such a device could be carried in the golfer's pocket or in the golf bag. A battery compartment (81) is shown for two 1.5 volt batteries (91, 92). It should be noted that one 9 volt battery or any alternative form of accessory battery, either dry cell or rechargeable, could be used. The battery(ies) could be nested in a formed plastic shell (94) to help mount the batteries.

Figure 4:
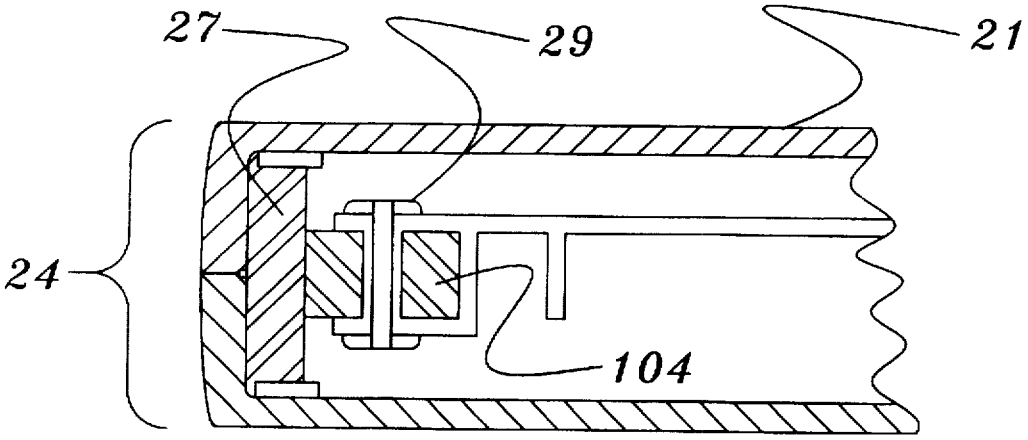
FIG. 4 is a closeup depiction of the control arm end in which is housed a steel plate.

Referring now to FIG. 4, it can be seen that the end (33) of the control arm (21) comprises a shroud (34) within which may be held a steel counterweight (27). The steel counterweight (27) is held in place with a rivet (29) or other fastening mechanism. Near the end (33) of the control arm

(21) is a shroud (34) which will, as will later be seen, facilitate the locking of the apparatus. The steel counterweight (27) is positioned so as to allow it to be exposed to the magnetic flux of the magnet (31) if the control arm (21) ever pivots about the wire coil spring (25) far enough to enter the magnetic field of the magnet (31).

Figure 5:
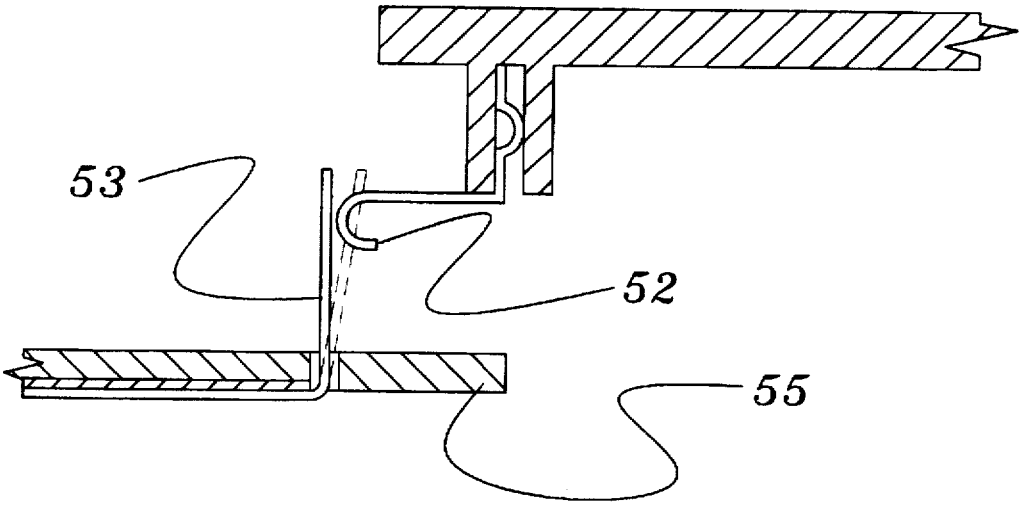
FIG. 5 is a closeup depiction of a side view of the alarm-triggering device with magnet.

FIG. 5 depicts the control arm end (33) as drawn to the magnet so as to trigger the alarm. Note that the control arm (21) will now be held in place until released as described above.

Figure 3:
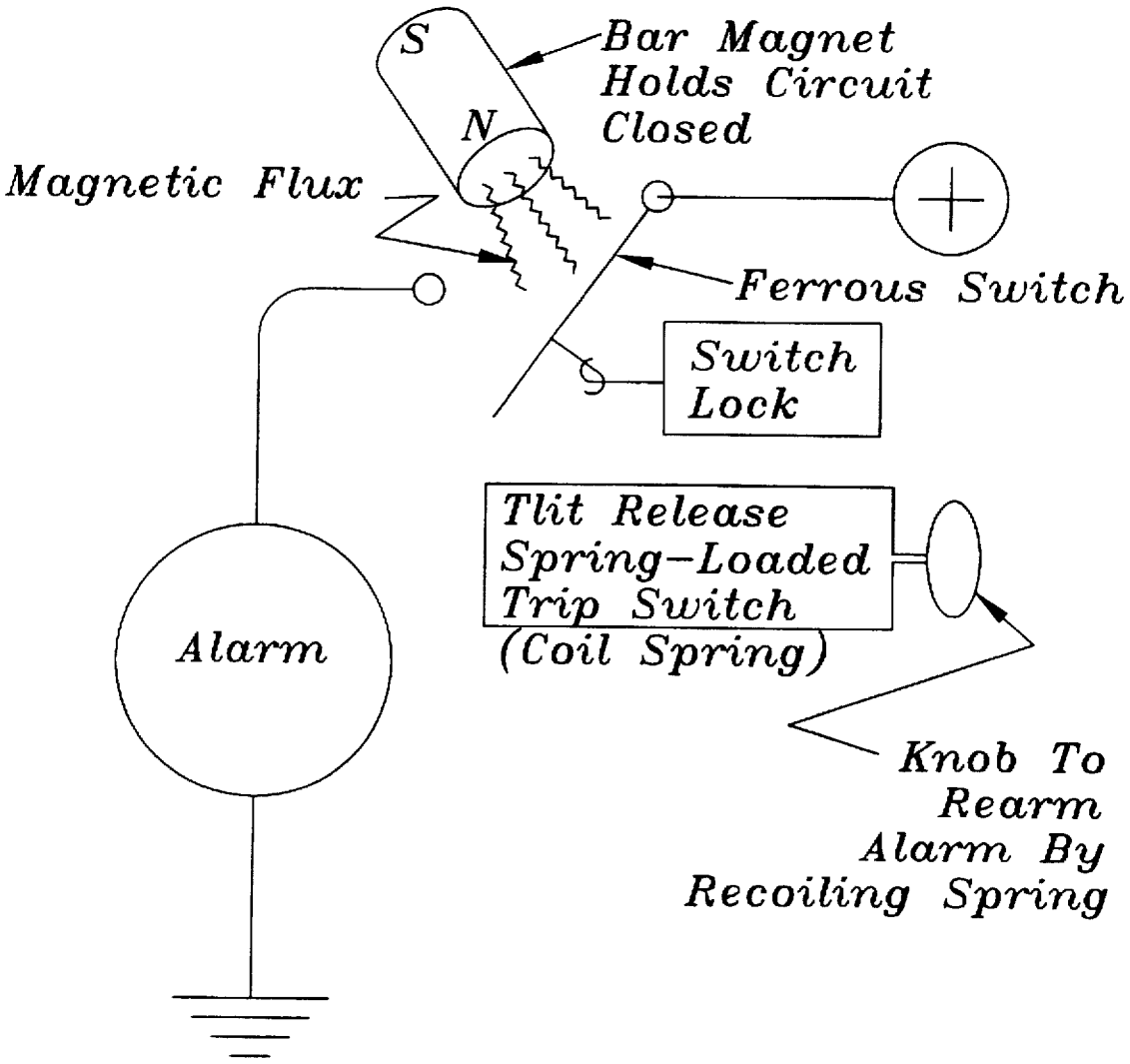
FIG. 3 is a block diagram of the primary functions of the apparatus.
Figure 6:
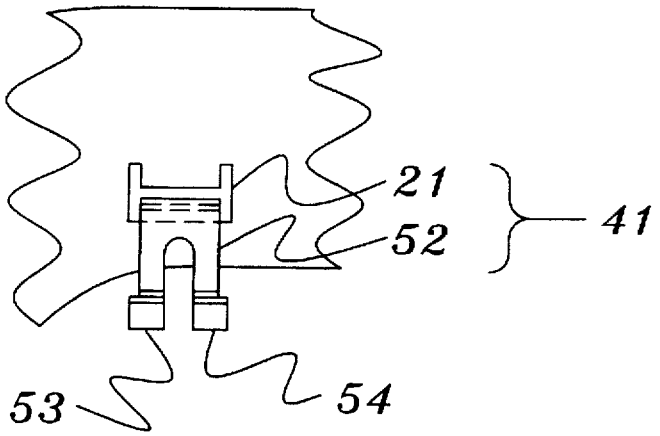
FIG. 6 depicts a front view the steel spring contact and circuit board points which facilitate the closing of the circuit to activate the alarm.

FIG. 6 depicts the contact points which cause the alarm circuit to close. Attached to and suspended from the control arm (21) is a generally "U"-shaped contact steel spring (42). The "U" shaped contact spring (42) is actually "U"-shaped in two planes. In the plane of the control arm (21) is a flat "U" with a planar top (43). The contact ends (44, 45) of this flat "U" shaped portion (43) culminate in thin "U" shaped portions (46, 47) which curl beneath the control arm (21). These are such that the apexes of these "U" shaped contact ends (44, 45) can give or bend slightly if the steel counterweight (not depicted in FIG. 6) falls within the magnetic field of the magnet (31), is attracted to it, and drawn against the wire coil spring (25) tension to rest against it, causing these "U" shaped end contacts (44, 45) to make contact with two electrical contact points (53, 54) extending from a simple circuit board (55) fixed to the back cover of the apparatus. This will cause a current flow from one of these electrical contact points (53), through the steel "U"-shaped contact ends (44, 45) points and "U" shaped contact spring (43), and to the other electrical contact point (54), closing, the alarm circuit current loop (FIG. 3) and triggering the alarm (51).

The control arm (21) will be held in place by the magnetic flux field between the magnet (31) and steel counterweight (27) until the control arm spring shaft knob (56) turned sufficient turns to build up enough tension in the wire coil spring (25) to break the magnetic field and the control arm (21) can be locked into place. It is not likely that a thief will know or be patient enough to continually turn the spring to achieve this result. While the control arm (21) has been depicted as a straight member, it could be curved or made with an angled portion. The requirements of this piece are that it must be rigid, capable of rotating within a desired plane, and capable of holding the desired accessories (such as the ferrous member and electrical contact points).

It should be noted that the magnetic field strength and coil spring tension must be selected so as to achieve the following required parameters. When released from the locked position, the tension on the coil spring must be sufficient to hold the control arm up out of the magnetic field when the apparatus sits generally upright, but to allow the control arm to pivot down into the magnetic field if the apparatus is tilted down (as would be the case with a golf bag slung over the shoulder) or suddenly jostled with a jerk (as would be the case with a golf bag jerked from a bag stand or golf cart upright position). Actually, the ultimate resolution of this is a function of three variables, namely the torque of the control arm, the tension on the coil spring, and the strength of the magnetic field within the alarm apparatus.

Figure 8:
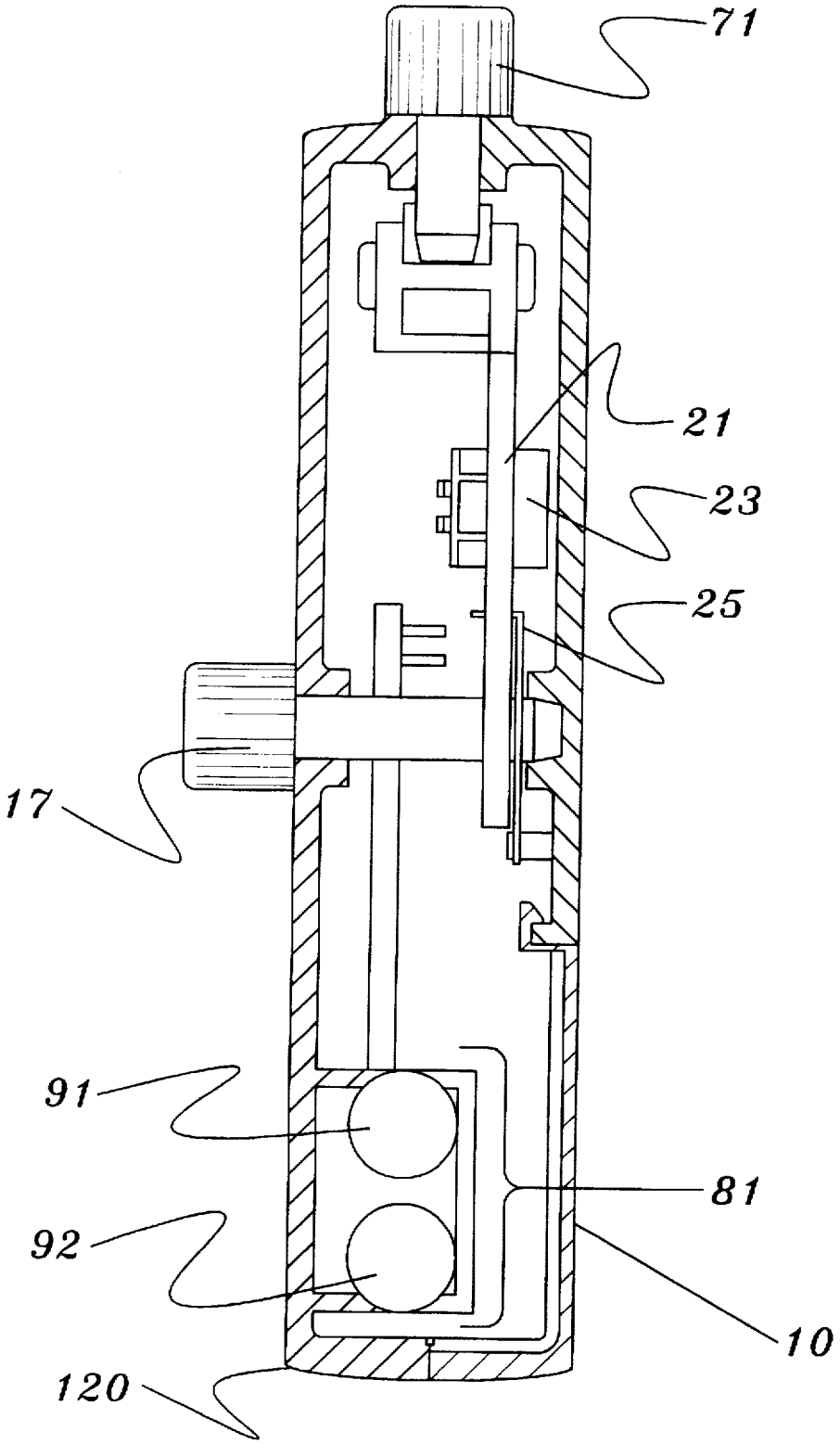
FIG. 8 is a cutaway side view of the apparatus.

FIG. 8, which is a cutaway view of the interior of the apparatus from the side in which the control arm (21) is locked in the locked, alarm off, position (101), depicts the relative positions of the styrene cushion (23), the locking screw (140), the wire coil spring (25), and the battery compartment (81). The magnet and circuit board are on the other side of the device in FIG. 8 and are not depicted.

FIG. 8 further depicts how, when desired, the device is locked in the disarmed position. The control arm (21), by turning the spring shaft knob (17) can be rotated through the apparatus until it rests against the styrene cushion (23) and is directed away from the magnet. The locking screw (140) is then turned until its flat end (57) makes snug contact with the shroud (34) of the control arm (21). In this manner the apparatus is locked into position and will not trigger the alarm (51).

Figure 9:
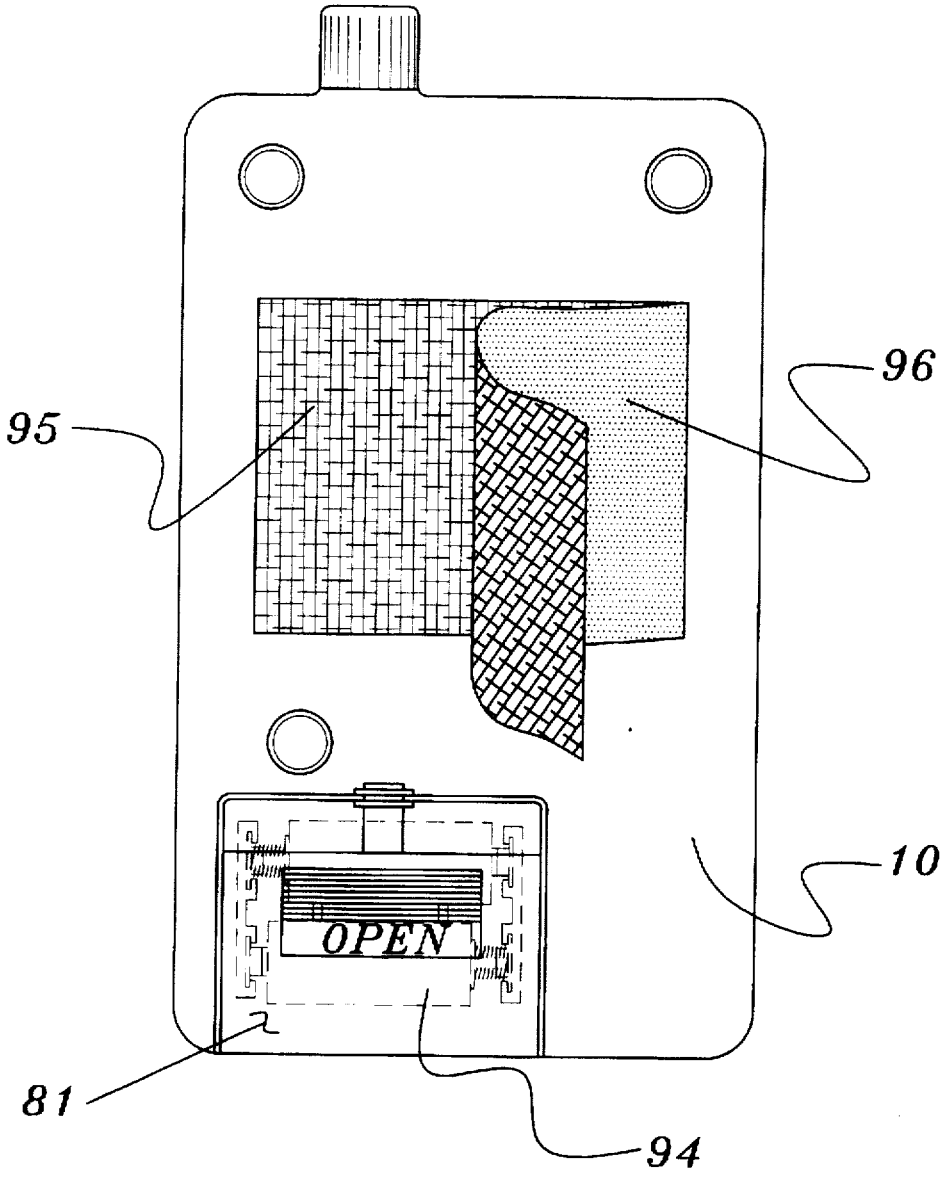
FIG. 9 is a view of the rear cover depicting how a VELCRO (®) tab could be used to simply attach the apparatus.

Making reference to FIG. 9, it is seen that a back cover assembly (94) slides out to give access to an opening for removing or adding new batteries in the battery compartment (81). Also depicted are two VELCRO (®) pieces (95, 96), one (95) for attachment to an appropriate place on the security alarm device (10), and the other (96) to be fastened to a golf bag. As previously depicted, three screws (121) hold security alarm covers (10, 120) together along a snap fit (not depicted) at bottom lower sides. Of course, any means of supplying battery power may be used, including permanent rechargeable batteries such as those used in remote phones.

The golf alarm should be mounted high on the golf bag top edge, so that the alarm can be heard loudly and clearly. This alarm design can be used with a variety of personal items, such as luggage, doors, bicycles, and other valuable items.

The design depicted herein uses two piece of VELCRO (®), one of which is mounted on alarm assembly, with the other mounted to the left side of golf bag. When mounting the alarm assembly, one must be careful of the strap mounting to the bag while the golf bag is attached to golf cart. Since the alarm assembly may be mounted on the outside position, it is sometimes wise to cover the alarm with a golf towel or other appliance making it less visible. The towel could move when the bag is in a horizontal position. Another reason for the two piece VELCRO (®) is that the alarm assembly is easily removable. It can be placed in a plastic bag and stored in a large zipper golf packet when not in use. The alarm assembly can accept any golf bag rack available, or just stand upright alone, but it is wise to hide the alarm assembly by covering the assembly with a golf wiping towel. Golfers invest large sums of money for today's golf equipment, but for a few dollars they can purchase one of these golf bag security alarm systems.

Figure 7:
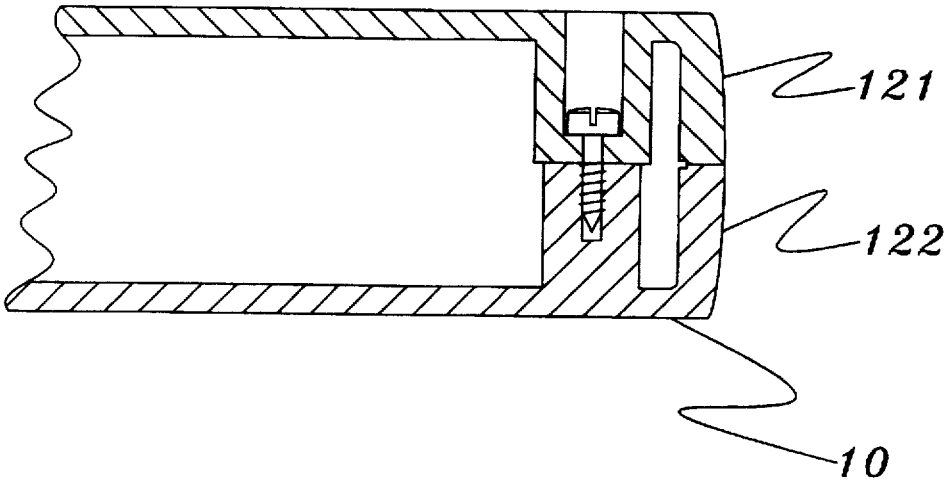
FIG. 7 is a depiction of a side view of the apparatus locking a front and rear cover together.

Making reference to FIG. 7, it can be seen that a front (121) and rear (122) cover of the security alarm device (10) can be fastened together by two or more identical fastening assemblies. These could have a channel (123) in the front cover (121) for receiving a fastening screw (129) which could be turned into a receiving, interior threaded channel (128) in the rear cover (122).

Of course, the alarm assembly could be designed to fit within one of the pockets on a golf bag rather than on the outside. This would make it a little more difficult to access, but would make it more difficult for a thief to locate. It also may be mounted in other ways. For instance, the bag could be adapted with a pocket to hold the alarm or a strap could be placed on the bag to receive a clip on the alarm, any mounting means which will allow the alarm to be mounted stably so that it will tilt with the motion of the bag.

It should also be considered that a variety of materials could be used to manufacture the cover. Such materials should, however, be water-resistant to withstand rain on the golf course and should be strong enough to protect the components from the impact a thief may subject it to by throwing it down or suddenly striking it upon activation.

The circuit switch was also described in terms of various curved springs with slight tension. It should also be considered that the alarm circuit switch could be comprised of a number of different switching configurations. The only requirement for any of these would be to provide a means of allowing a circuit loop to be easily and reliably opened and closed based upon the positioning of the control arm (21) and offer little resistance to the movement of the control arm (21). For instance, conducting brushes on the control arm (21) could be connected to each other and positioned so as to brush over respective conducting plates on the circuit board (53) and complete the circuit could be used. Such conducting brushes are well known in the electrical art and need not be separately described or depicted other than to mention them as an alternative here. There are many other ways in which this connection may be accomplished.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. An alarm apparatus for a golf bag, the alarm apparatus further comprising;

an alarm case which may be housed within a compartment of or concealed upon a surface of a small portable container similar to a golf bag in a stable orientation, said alarm case further comprising within:

a power supply, said power supply further comprising one or more batteries;

a gravity activated alarm triggering means, said triggering means adapted to, from an active, or armed, alarm position, remain in an "alarm-off" position if said portable container is undisturbed or, alternatively, move and be locked into an alarm-on position if said portable container is jerked, lifted, or otherwise disturbed from its desired rest position and said gravity activated triggering means further being adapted to be moved and locked into an inactive, or disarmed, position;

said gravity activated triggering means further comprising an adjustable coiled spring apparatus fastened to the interior of said alarm case, said coiled spring apparatus further comprising an adjusting axle at its center from which said coiled spring apparatus spirals out, said adjusting axle further being adapted to pass through said alarm case to a knob on the exterior of said alarm case by which said axle is turned in order to adjust or reposition said coiled spring apparatus;

said coiled spring apparatus further being adapted with an alarm triggering member, said alarm triggering member further comprising a rigid member mounted upon said coiled spring apparatus in such a manner as to, in an active alarm, or armed position, move back and forth through a range of motion against the tension of said coiled spring apparatus, said range of motion including an alarm-off position at equilibrium and, when said alarm apparatus is moved, lifted or jerked while said alarm is in its active, or armed position, said range of motion includes an alarm-on position;

said alarm triggering member further comprising an alarm-on locking apparatus, said alarm-on locking apparatus further comprising a permanent magnet mounted within said alarm case in a position to attract and hold a ferrous member mounted upon said alarm triggering member when said alarm triggering member is moved to a position within said alarm-on position;

said alarm triggering member further comprising a switching apparatus, said switching apparatus adapted to connect and close an electrical circuit between said power supply and an audio) alarm which, when electrically energized, emits an audio alarm sound;

an alarm switching means, said alarm switching means adapted to, when said gravity activated triggering means is moved to said alarm-on position, close a switch adapted to electrically energize said audio alarm;

said switch being in electrical communication between said power supply and said audio alarm by means of an electrical circuit path housed within said alarm case; and said audio alarm further comprising an electrically activated audio signal of sufficient volume and intensity to be heard from a distance of 50 feet or more across open spaces by a person of normal hearing.

2. The alarm apparatus described in claim 1 in which said coiled spring apparatus may be adjusted into a position enabling said alarm triggering member to be mechanically locked into an inactive alarm, or disarmed, position so that the alarm apparatus may be moved from one place to another without causing said alarm triggering member to move into said alarm-on position.

3. The alarm apparatus described in claim 1 in which said electrical circuit further comprises an electrical circuit board mounted within said alarm case, said electrical circuit board further comprising an electrical circuit path between the terminals of said power supply, said switching apparatus, and said audio alarm, said electrical circuit board being further adapted with points adapted to receive and maintain electrical communication with said switching apparatus.

4. The alarm apparatus described in claim 3 in which said switching apparatus further comprises a conducting member, said conducting member being adapted with electrical contact members, said electrical contact members adapted to be received by the points of said electrical circuit board.

5. The alarm apparatus described in claim 4 in which said electrical contact members each comprise a curved, thin, flexible contact member, said curved, thin, flexible contact member being adapted with a level of resiliency so that, when said contact member is pulled by the magnetic attraction of said magnet into said alarm-on position, the outer curved portion of each said electrical contact members will be drawn against said resiliency by the force of said magnetic attraction to make and maintain contact with a corresponding said point of said electrical circuit board and will, upon release from said alarm-on position, spring back into its equilibrium position.

6. The alarm apparatus described in claim 1 in which an alarm-off locking mechanism comprises a screw disposed in a threaded channel within the alarm cover and positioned to be turned by a locking knob outside said alarm cover from a point allowing said alarm switching means to freely move within said alarm apparatus throughout its range of motion to a point at which the interior end of said screw presses against and locks said alarm switching means into said alarm-off position.

7. The alarm apparatus described in claim 2 in which an alarm-off locking mechanism comprises a screw disposed in a threaded channel within the alarm cover and positioned to be turned by a locking knob outside said alarm cover from a point allowing said alarm switching means to freely move within said alarm apparatus throughout its range of motion to a point at which the interior end of said screw may press against and lock said alarm switching means into said alarm-off position.

8. The alarm apparatus described in claim 3 in which an alarm-off locking mechanism comprises a screw disposed in a threaded channel within the alarm cover and positioned to be turned by a locking knob outside said alarm cover from a point allowing said alarm switching means to freely move within said alarm apparatus throughout its range of motion to a point at which the interior end of said screw may press against and lock said alarm switching means into said alarm-off position.

9. The alarm apparatus described in claim 4 in which an alarm-off locking mechanism comprises a screw disposed in a threaded channel within the alarm cover and positioned to be turned by a locking knob outside said alarm cover from a point allowing said alarm switching means to freely move within said alarm apparatus throughout its range of motion to a point at which the interior end of said screw may press against and lock said alarm switching means into said alarm-off position.

10. The alarm apparatus described in claim 5 in which an alarm-off locking mechanism comprises a screw disposed in a threaded channel within the alarm cover and positioned to be turned by a locking knob outside said alarm cover from a point allowing said alarm switching means to freely move within the alarm apparatus throughout its range of motion to a point at which the interior end of said screw may press against and lock said alarm switching means into said alarm-off position.

11. The alarm apparatus described in claim 1 in which an power supply comprises one or more batteries selected from any one of the following sizes:

size n, size d, size c, size a, size aa, size aaa, or any one of a variety of nickel-cadmium, dry cell, wet cell, rechargeable, or other small batteries.

12. The alarm apparatus described in claim 1 in which the cover of said alarm apparatus is adapted to be fastened to a surface of the interior or exterior of a golf bag or other vessel or container by means of any one of the following methods:

one or more VELCRO (R) strips positioned on both said alarm cover and a surface desired for positioning;

two or more snaps and corresponding snap receiving members positioned on said alarm cover and desired surface for positioning or the desired surface for positioning and alarm cover respectively;

a pocket positioned upon said surface desired for positioning adapted to receive said alarm apparatus and hold it in a desired orientation; or one or more fastening members of any type adapted to hold a small, generally flat and lightweight case in a stable position within a container or vessel.

13. The alarm apparatus described in claim 1 in which said audio alarm is adapted to transmit any one or combination of the following sounds:

a chirping sound, a steady shrill tone, a siren sound, or a combination of alternating tones.

14. The alarm apparatus described in claim 2 in which an audio alarm is adapted to transmit any one or combination of the following audio alarm sounds:

a chirping sound, a steady shrill tone, a siren sound, or a combination of alternating tones.

15. The alarm apparatus described in claim 1 in which an alarm case is adapted with an audio transmission port adapted to permit said audio alarm sound to be efficiently transmitted from said audio alarm to the outside of said alarm case and still protect the interior of said alarm case from the elements of weather and the atmosphere.

16. The alarm apparatus described in claim 13 in which an alarm case is adapted with an audio transmission port adapted to permit said audio alarm sound to be efficiently transmitted from said audio alarm to the outside of said alarm case and still protect the interior of said alarm case from the elements of weather and the atmosphere.

17. The alarm apparatus described in claim 14 in which an alarm case is adapted with an audio transmission port adapted to permit said audio alarm sound to be efficiently transmitted from said audio alarm to the outside of said alarm case and still protect the interior of said alarm case from the elements of weather and the atmosphere.

* * * * *